US007200874B2

(12) United States Patent
Leguenec

(10) Patent No.: US 7,200,874 B2
(45) Date of Patent: Apr. 10, 2007

(54) PROTECTIVE HEADGEAR

(76) Inventor: Joseph R. Leguenec, 4704 Wind River Rd., Austin, TX (US) 78759

( * ) Notice: Subject to any disclaimer, the term of this patent is extended or adjusted under 35 U.S.C. 154(b) by 0 days.

(21) Appl. No.: 11/161,842

(22) Filed: Aug. 18, 2005

(65) Prior Publication Data

US 2007/0050887 A1 Mar. 8, 2007

(51) Int. Cl.
*A42B 1/04* (2006.01)

(52) U.S. Cl. ..... 2/202; 2/204; 2/205; 2/206; 2/207; 2/171; 2/174; 2/425; 132/58

(58) Field of Classification Search ..... 2/207, 2/174, 202, 171, 204, 205, 206, 425; 132/58
See application file for complete search history.

(56) References Cited

U.S. PATENT DOCUMENTS 5,048,128 A 9/1991 Watson, Jr.
5,062,157 A 11/1991 Muta
5,161,260 A * 11/1992 Reynolds ..... 2/207
6,014,776 A * 1/2000 DeVinzio ..... 2/207
6,738,986 B1 * 5/2004 Martin ..... 2/207
2005/0034215 A1 * 2/2005 Harrison et al. ..... 2/207

* cited by examiner

*Primary Examiner*—Gary L. Welch
*Assistant Examiner*—Alissa Tompkins
(74) *Attorney, Agent, or Firm*—Michael L. Greenberg; Greenberg & Lieberman, LLC

(57) ABSTRACT

Headwear that tightly fits the head of the user to protect the head and the hair of the user. The headwear is composed of two parts: a body and a band. The body is made from three panels and a back flap. The body has a hem to conceal and hold the band. The band is composed of elastic with cloth on the ends to facilitate tying.

12 Claims, 3 Drawing Sheets

PROTECTIVE HEADGEAR

FIELD OF THE INVENTION

The present invention relates to apparel and more specifically headwear and protective headwear.

BACKGROUND OF THE INVENTION

Do-rags are typically worn by athletes and motorcycle riders. While some elements of the population might wear do-rags for fashion, athletes and motorcycle riders wear do rags because they need to wear them—fashion is not the primary concern.

For example, a motorcycle rider typically wears a do rag to maintain some semblance of a groomed head, so that the wind does not blow the helmetless motorcycle rider's hair into a messy hodgepodge. The do-rag, in this instance, keeps the motorcycle rider's hair nicely combed or in whatever position the motorcycle rider desires, as the do-rag fits over the motorcycle rider's hair and prevents the wind from blowing the hair.

Alternatively, do-rags are worn under helmets of athletes and motorcycle riders, so that the user's head has a barrier between the user's hair and the helmet. It is desirable that the do-rag absorb perspiration so that the helmet does not slip around on top of the user's head, and moreover, so that perspiration does not interfere with the user's line of sight by dripping in the user's eyes.

Without question, do-rags serve their purpose well. However, there are problems with do-rags. When worn while traveling at high speeds without a helmet, do-rags tend to loosen and fly off the user's head. The ties that typical do-rags employ to secure to the user's head simply loosen under the pressure of the wind, and cause many do-rags to fly off the user's head and be lost forever on the open highways. In addition, do-rags worn under helmets are also prone to fit problems. The upward pressure exerted on a do-rag when a helmet is removed from a user's head pulls the do-rag that is worn between the user's head and the helmet upward and off of the user's head.

It is desirable to have a do-rag that will maintain its fit upon the user's head. Moreover, it is desirable for the user, whether traveling in high winds or quickly pulling off a helmet, to need not worry about removing the do-rag from the user's head. Quite simply, a do-rag is desired that, once fastened upon the user's head, will remain on the user's head until the user intends to remove it.

U.S. Pat. No. 5,161,260 granted to Reynolds on Nov. 10, 1992, illustrates headwear for protection. However, Reynolds' headwear is made from a single piece of material, which does not allow for a tight fit around the head and it does not have any elastic securing piece hidden inside a hem.

U.S. Pat. No. 5,048,128 granted to Watson, Jr. on Sep. 17, 1991, illustrates headwear for protection. However, Watson, Jr.'s headwear is made from a single rectangular piece of cloth so that it does not fit on the head of the user in a fitted manner. Watson, Jr.'s headwear has an adjustable element to keep the headwear in place, but that element is visible around the entire headwear and is not made of elastic.

U.S. Pat. No. 5,062,157 granted to Muta on Nov. 5, 1991, illustrates protective headwear. However, Muta's headwear does not completely cover the head and hair. Further, the covering body is comprised of only a single piece of cloth, which does not allow for a tight fit around the head of the user.

U.S. Pat. No. 6,014,776 granted to DeVinzio on Jun. 18, 2000, illustrates decorative headwear. However, DeVinzio's headwear does not have an integrated band to hold the headwear. It further does not have a hem to hide the strip of cloth to hold the headwear tight, and the headwear permanently attaches the tightening strip of cloth to the headwear. Both of these features produce an effect that would not reliably hold DeVinzio's headwear to the head of the user. Finally, the tightening strip of cloth is not long enough to tie which necessitates an additional fastening element.

Thus, a need has been established for an improved do-rag that will reliably stay on the user's head and resist wind and other pressure that can arise from removing a helmet.

SUMMARY OF THE INVENTION

The present invention is preferably made of cotton. but stretch-type fabrics can also be employed. The present invention has a first piece of fabric creating the right-hand side of a skullcap. Next, the present invention has a second piece of fabric creating the left-hand side of the skullcap. Then, the present invention has a piece of fabric that is placed between the right-hand side and left-hand side pieces of fabric that includes a "tail" extending downward beyond the skullcap and over a portion of the wearer's neck. Also, the present invention has an elastic band that extends from the mid-point at the front of the skullcap and extends three-quarters of the way around both the right-hand and left-hand sides of the skullcap. The present invention further has a "tie" that has two pieces of fabric sewn back-to-back to create a single piece of material that is attached to one end of the elastic band. The tie extends beyond the circumference of the skullcap and is pulled to contract the elastic band around the wearer's head. Additionally, the present invention has a "tie" that consists of two pieces of fabric sewn back-to-back to create a single piece of material that is attached to the other end of the elastic band. The tie extends beyond the circumference of the skullcap and is pulled to contract the elastic band around the wearer's head. The present invention has a hem of fabric that is attached to the pieces or fabric creating the right-hand and left-hand side of the skullcap, as well as the piece of fabric that is placed between the right-hand side and left-hand side pieces of fabric. The hem extends equidistant from the midpoint of the front of the skullcap and down both sides to the rear of the skullcap and encloses, or hides, the elastic band that extends three-quarters of the circumference of the skullcap and the two points where the ties are attached to the elastic band.

Two important improvements over the relevant art are, first, an elastic band sewn inside the traditional do-rag's hem that spans approximately three-quarters the way around the do-rag. Second, wherein in the traditional do-rag design, the two ties are attached to the rear of the skullcap, in the present invention; the two ties are sewn to either side of the elastic band inside the hem. By sewing the elastic band with the ties attached at either end inside the hem, the present invention do-rag looks just like the traditional do-rag design, but functions much better.

The elastic band with the ties attached at either end allow a tighter and much more secure fit than the traditional do-rag design. Although the present invention is preferably 100% cotton just like the traditional do-rag, when you pull the ties at the back of the present invention do-rag, the elastic band inside the hem extends. When the ties are released after tying the two traditional "knots" to secure the do-rag, the elastic then contracts around the wearer's head. Once the present invention do-rag is tied, the elastic band contracts and expands slightly as wind pressure created from speed pushes the present invention do-rag backward on the wearer's head, as well as upward as the wind pressure circulates under the rear of the do-rag and the wearer's scalp as it travels down the neck. As a result of the slight expansions and contractions of the elastic in the present invention do-rag, there is minimal or no "tugging" on the ties and thus no loosening of the ties. In other words, the present invention do-rag design not only creates a tighter initial fit, the elastic acts kind of like a "shock absorber" against the wind, taking the "pull" or tug away from the rear of the do-rag where the ties are tied. Because there is less wind pressure against the ties, they are not subject to the wind pressures that normally cause ties to loosen. Further, because the present invention do-rag's unique elastic band creates an initial tighter fit around the user's head than traditional do-rag designs, the present invention do-rag will stay on the wearer's head each time he or she removes his or her helmet.

DETAILED DESCRIPTION OF THE PREFERRED EMBODIMENT(S)

The present invention is designed to stay on the head of the user, while providing a stylish, tight fit. The present invention protects the wearer's head, hair, and the back of the neck from the harmful effects of the sun, as well as from dust and other airborne contaminates. Additionally, when the covering is made of a material such as cotton, it affords the quicker evaporation of sweat. The design of the present invention provides a stylish fit that appears to the observer of the user to be a standard do-rag, yet has many features that provide a tighter and more secure fit.

Figure 1:
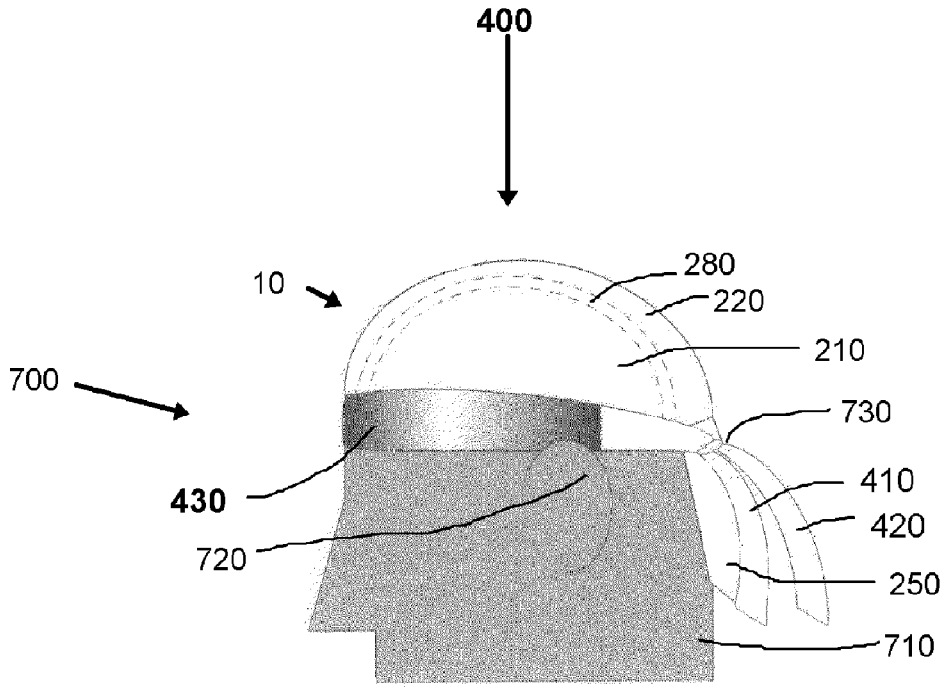
FIG. 1 is an illustration of the headwear being worn from a side angle.
Figure 2:
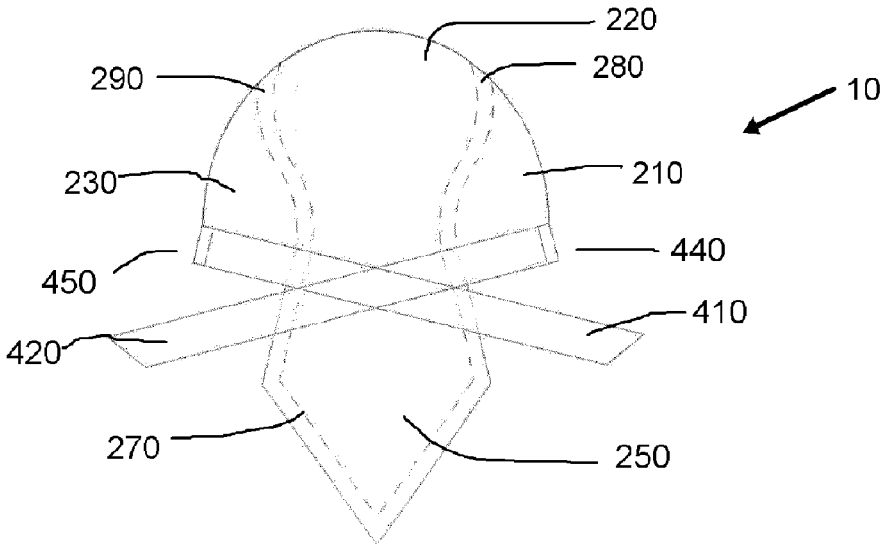
FIG. 2 is an inside out view of the headwear from the rear.

In FIG. 1, a side view of the preferred embodiment of the present invention (10) is shown on the head (700) of a user, and in FIG. 2 a rear view of the present invention (10) is shown. The preferred embodiment of the present invention has two main parts: the body (200) shown in FIG. 3, and a band (400) shown in FIG. 4 that fits into a hem (300) of the body (200). The body (200) is designed to tightly fit the upper portion of a head (700). In FIG. 4, the band (400) fits inside the hem (300) and is of sufficient length to allow the user to tie the band (400) at the back of the user's head (730), as illustrated in FIG. 1.

Figure 3:
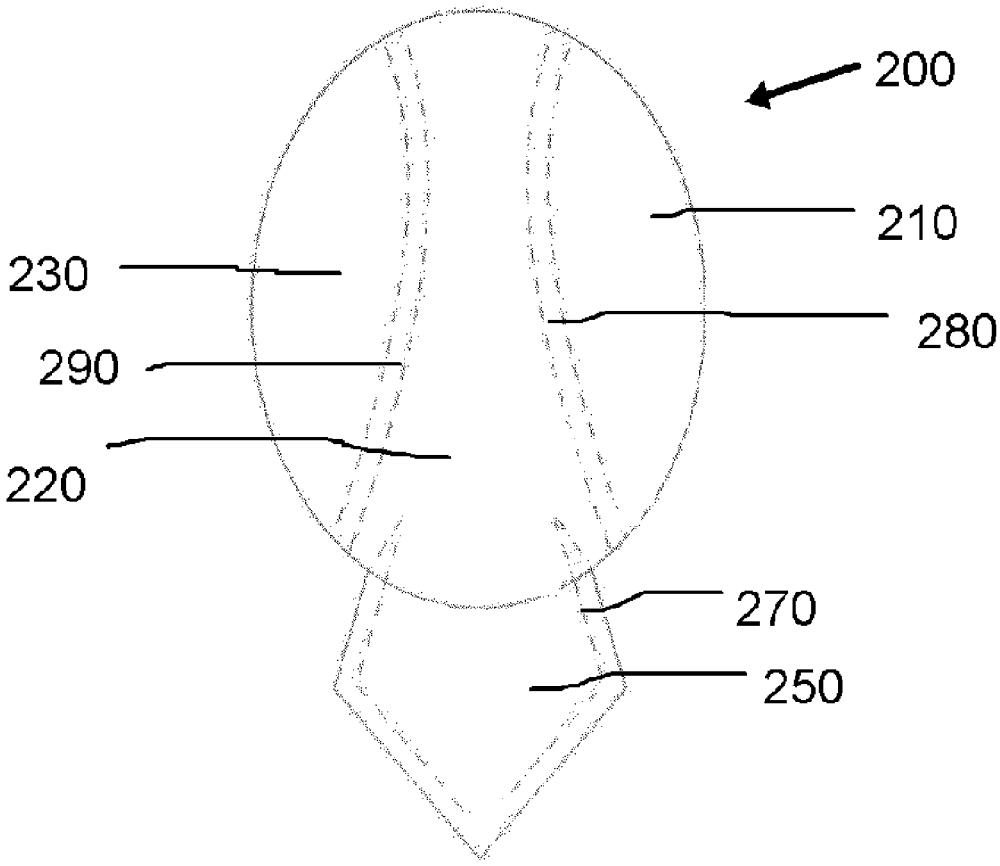
FIG. 3 is inside out view of the body part of the headwear from above.
Figure 4:
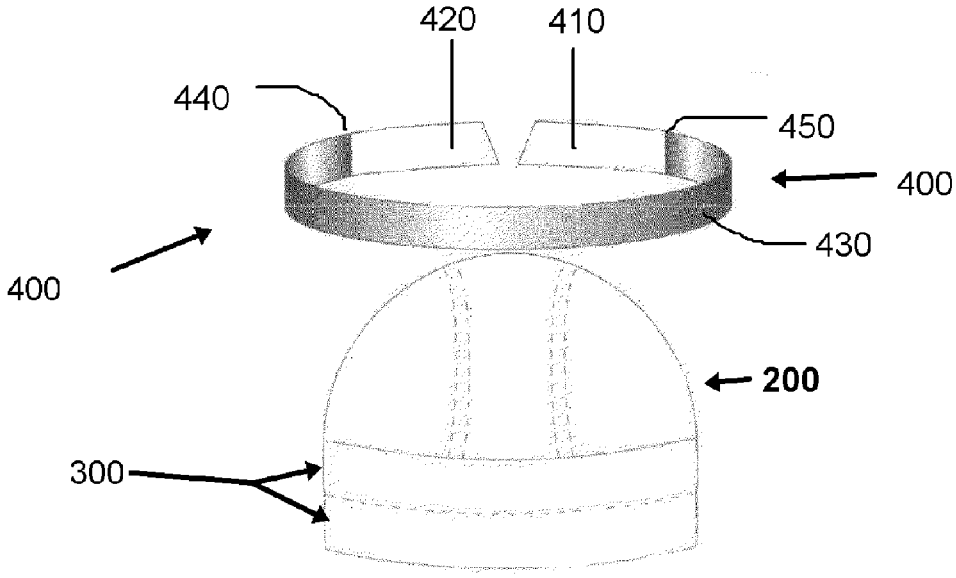
FIG. 4 illustrates how the band fits into the hem on the body from the front.

The body (200) is illustrated in FIG. 3. In the preferred embodiment, the body (200) has four separate pieces of material: the right panel (230), the middle panel (220), the left panel (210), and the back flap (250). In the preferred embodiment, the material is made of an absorbent material such as cotton, but almost any material used for clothing could be used. The four separate pieces of material (210, 220, 230, 250) that make the body (200) are joined together with a double row of stitching (280, 290, 270), preferably. The shape of the right panel (230), the left panel (210), and the middle panel (220) are such that the shape combined fits the shape of the head of the user tightly (700). More than three pieces of material could be used to fit the shape of the head of the user (700), or a single piece or panel could be used if the material were stretchable. The back flap (250) hangs down to protect the neck of the user (710).

A hem (300), best illustrated in FIG. 4, is important to the present invention because it allows the present invention to look like a traditional do-rag while performing and functioning much better than the traditional do-rag. The hem (300) is sewn completely around the bottom of the body (200) to allow the band (400) to fit inside the hem (300). The hem (300), is shown as unfolded in FIG. 4, but is actually folded and secured together via conventional stitching when the present invention is made. In other words, the lower of the two strips of material labeled as hem (300) in FIG. 4 would be folded up to overlap and form a channel when the present invention is used. Thus, the hem (300) would obscure band (400) as shown in FIG. 1. FIG. 1 does not show hem (300) so that the location of band (400) can be appreciated.

Best illustrated in FIG. 2, attached to both ends of elastic (430), the right-hand tie (410) and left-hand tie (420) exit through the right-hand side (450) and left-hand side (440), respectively, of the body (200) through the hem (300) that is sewn completely around the bottom of the body (200). Shown on the user (700) in FIG. 1, the elastic (430) is positioned only partially around the body (200). The elastic (430) of band (400) is darkened to distinguish it from the ties (410 and 420) that are attached to the elastic (430). While all of the elastic (430) of band (400) is concealed inside the hem (300), only a section of each attached tie (410 and 420) is hidden inside the hem (300). The remainder of each tie (410 and 420) exits at either end of the hem (300) at the back of the body (200); allowing sufficient length for the user to grasp, pull and knot each tie.

Figure 5:
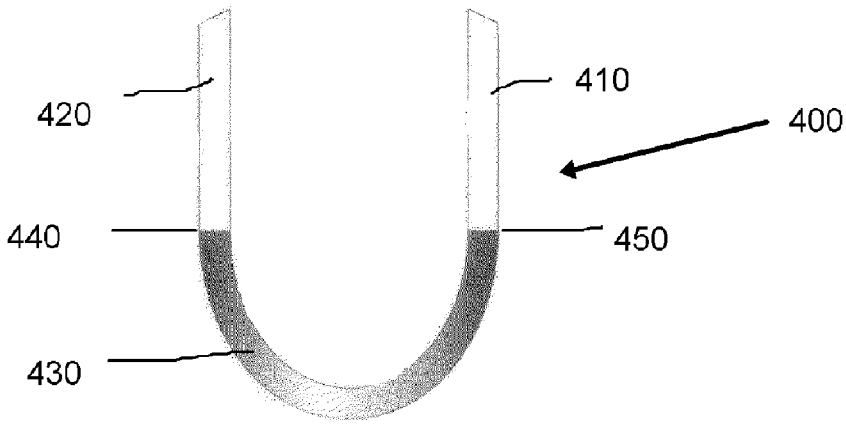
FIG. 5 illustrates the elastic band with the two ties attached.

FIG. 5 illustrates the band (400) of the present invention. The band (400) allows the user to tighten the present invention around their head (700) while the hem (300) hides the band so that the headwear appears not to have elastic. The band has three parts: the elastic (430), and two ties (410, 420). In the preferred embodiment the two ties (410, 420) are made from the same material as the body (200). However, the ties (410, 420) could be made of almost any material used for clothing. The two ties (410, 420) are stitched to the elastic piece (430) to form the band (400). The ties (410, 420) are not made of elastic, as the body (200) material is better for tying, and further, it is more stylish to have a material other than elastic showing outside the hem (300). The band (400) fits inside the hem (300) of the body (200) to hide the elastic (430) and to insure that the band (400), and thus the body (200), remains on the head of the user (700). The band (400) design allows for users with different size heads (700) to tie the present invention tightly around their head (700). The band (400) further allows for a tight fit to be achieved even if the material of the body (200) or the band (400) shrinks or expands.

Having illustrated the present invention, it should be understood that various adjustments and versions might be implemented without venturing away from the essence of the present invention. The present invention is not limited to the embodiments described above, and should be interpreted as any and all embodiments within the scope of the following claims.

What is claimed is:

1. An article of headwear for a user's head, comprising:

at least one panel to cover a user's head;

a hem, extending around said at least one panel;

an elastic strip having a first and second end solely enclosed within said hem, encompassing the majority of the periphery of said at least one panel; and non-elastic ties attached to each end of said elastic strip, wherein said ties control the fit of the do-rag on the user's head once they are pulled by the user.

2. The article of claim 1, wherein said at least one panel is shaped to form fit the average user's head without producing excess material.

3. The article of claim 1, wherein said hem has ties.

4. The article of claim 3, wherein said ties are positioned to fall below the nape of the user's neck, so that said ties can be tied below the bottom of a helmet worn by the user.

5. The article of claim 3, wherein said ties are made of two pieces of fabric sewn together.

6. A device of headwear, comprising:

a right panel;

a center panel, in communication with said right panel;

a left panel, in communication with said center panel;

a hem in communication with said panels;

an elastic strip having a first and second end solely enclosed within said hem, encompassing the majority of the lower periphery of the device; and a rear flap and non-elastic ties that are in communication with said center panel; wherein said ties are pulled by the user to control the fit of the device of headwear on the user's head.

7. The device of claim 6 wherein the said three panels are shaped to fit snuggly over a person's head.

8. The device of claim 6 wherein the said three panels are connected by means of stitching.

9. The device of claim 6 wherein the said rear flap is attached to the center panel by stitching.

10. The device of claim 6 wherein the spherical shape created by the three panels has a hem that is wide enough to conceal said elastic strip.

11. The device of claim 6 wherein the length of the band is long enough to allow the user of the device to tie the two ends of the band behind his/her head.

12. The device of claim 6 wherein the said band is comprised of three parts:

an elastic center part; part one attached to one end of the elastic part; part two attached to the other end of the elastic part.

* * * * *